US006382071B1

(12) United States Patent
Bertani

(10) Patent No.: US 6,382,071 B1
(45) Date of Patent: May 7, 2002

(54) BOLA CAPTURING APPARATUS

(76) Inventor: Gilbert A. Bertani, 5515 Dashwood, #79, Houston, TX (US) 77081

( * ) Notice: Subject to any disclaimer, the term of this patent is extended or adjusted under 35 U.S.C. 154(b) by 0 days.

(21) Appl. No.: 09/633,769

(22) Filed: Aug. 7, 2000

(51) Int. Cl.[7] ..... B64D 1/04
(52) U.S. Cl. ..... 89/1.34; 124/59
(58) Field of Search ..... 89/1.34; 102/504; 43/58, 59; 124/59; 119/717

(56) References Cited

U.S. PATENT DOCUMENTS

| | | | | | |
|---|---|---|---|---|---|
| 1,217,415 | A | * | 2/1917 | Colomyjczuk | 89/1.34 |
| 1,229,421 | A | * | 6/1917 | Downs | 102/504 |
| 1,304,857 | A | * | 5/1919 | Davis | 89/14.05 |
| 1,309,530 | A | * | 7/1919 | Lamberson | 102/504 |
| 1,312,764 | A | * | 8/1919 | Straub | 102/504 |
| 2,469,533 | A | * | 5/1949 | Wellcome | 89/1 |
| 2,668,499 | A | * | 2/1954 | Mourlaque | 102/89 |
| 4,559,737 | A | * | 12/1985 | Washington | 43/59 |

* cited by examiner

*Primary Examiner*—Michael J. Carone
*Assistant Examiner*—Michelle Thomson
(74) *Attorney, Agent, or Firm*—Bill B. Berryhill

(57) ABSTRACT

Apparatus for capturing fleeing animals or persons comprises a gun having a barrel and stock to which are attached a pair of elongated tubular members, one on each side of the gun barrel and substantially parallel thereto. Attached to the end of the gun barrel is a guide assembly which includes a central tube coaxially aligned with the gun barrel and on either side of which are outwardly extending guides. Retainer assemblies provided near the rear ends of the tubular members include chambers which are in fluid communication with the interior of the gun barrel. The apparatus comprises a bola assembly having a central plug from each side of which extends a cord at the end of which are weights. The plug is insertable into the central tube of the guide assembly and the weights are insertable through the elongated tubes for releasable engagement with the retainer assemblies. Firing of a specially designed shell directs gases to the retainer chamber activating the retainer assemblies for release of the weights as the central bola plug is struck by a portion of the shell propelling the bola assembly toward the fleeing animal or person.

20 Claims, 5 Drawing Sheets

BOLA CAPTURING APPARATUS

BACKGROUND OF THE INVENTION

1. Field of the Invention

The present invention pertains to apparatus for capturing or snaring fleeing animals or persons. More specifically, the present invention pertains to capturing or snaring apparatus in which a bola is propelled by a specially designed gun for wrapping around the legs of an animal or person fleeing from the operator thereof.

2. Description of the Prior Art

The typical bola is a weapon consisting of two or more stone or iron balls attached to the ends of a cord for hurling at an animal or a person, entangling the animal or person for capture thereof. Such weapons are limited by the skill and strength of the person hurling the bola.

In more recent times, bola capturing devices have been designed in which the bola is ballistically deployed by specially designed guns to capture a fleeing animal or person without injury thereto. Examples of such devices may be seen in U.S. Pat. Nos. 4,559,737; 4,912,869 and 5,750,918. Although a number of bola type capturing devices have been developed, continued development, especially for capturing of fugitives without injury thereto, is desired.

SUMMARY OF THE PRESENT INVENTION

The present invention comprises a modified shotgun having a barrel and stock. The purpose of the gun is to fire an approximately three ounce bola assembly which comprises a central plug from each side of which extends a cord and a weight member. The bola can be fired, fifty or sixty yards, to entangle the legs of a fleeing criminal, an elusive animal or the like. Attached to the gun, one on each side of the barrel and substantially parallel thereto, are a pair of elongated tubular members. The forward ends of the tubular members are open, a retainer assembly being disposed at the rearward end of each tubular member. Each of the retainer assemblies has a chamber in fluid communication, through a conduit and port in the gun barrel, with the interior of the gun barrel just forward of the end of a shell when the shell is properly placed in the gun barrel. A guide assembly is attached to the forward end of the gun barrel and provided with a tube coaxially aligned therewith and on each side of which are outwardly extending guides.

The central plug of the bola assembly is insertable into the central tube of the guide assembly and each of the weight members is releasably engageable with a respective one of the retainer assemblies, the cords of the bola assembly then engaging a corresponding one of the guides. The firing of a shell in the gun barrel creates gasses which are directed to the chambers activating the retainer assemblies and releasing the weight members. At substantially the same time, the central plug of the bola assembly is struck by a rubber slug, propelling the bola plug from the central tube and the weight members from the elongated tubular members causing the bola cords to wrap around any fleeing animal or person in their path.

The gun portion of the apparatus of the present invention can be easily made by modifying a conventional shotgun. The tubular members, retainer assemblies and guide assembly are attached to the modified shotgun providing an easy to load and operate apparatus which is extremely accurate and effective in its purpose.

While the primary objects and advantages of the invention have been stated, many other objects and advantages will be apparent from reading the specification which follows in conjunction with the accompanying drawings.

DESCRIPTION OF A PREFERRED EMBODIMENT

Figure 1:
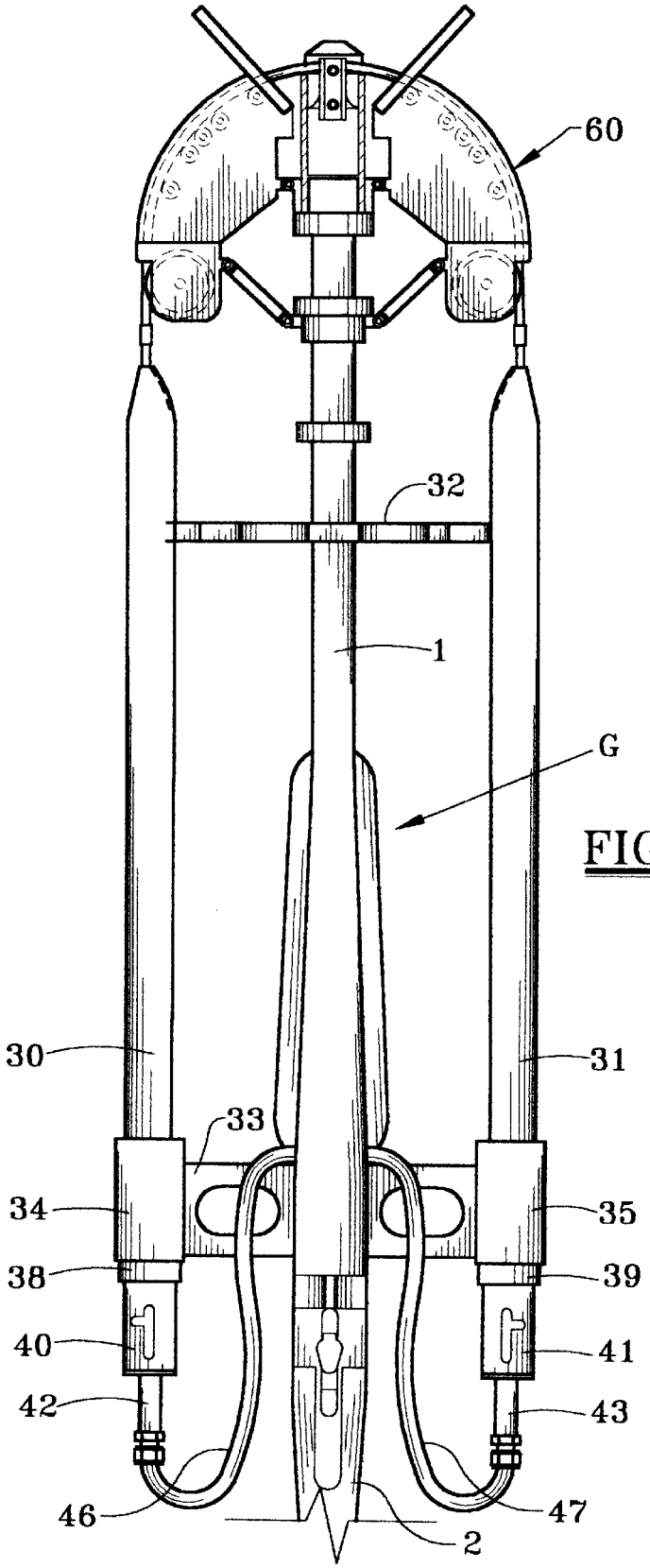
FIG. 1 is a longitudinal view, as viewed from the top, of a gun and associated apparatus for capturing fleeing animals or persons, according to a preferred embodiment of the invention, the rearward portion of the gun stock being cut away.

Referring first to FIG. 1 there is shown apparatus of the present invention which is designed primarily for the capturing of fleeing animals or persons with minor or no injury thereto. The apparatus is symmetrically mounted on a gun G having a gun barrel 1 and a gun stock 2. The gun G is a modified shotgun which uses a modified shotgun shell to propel a bola assembly for entanglement with the legs of a fleeing animal or person.

Figure 2:
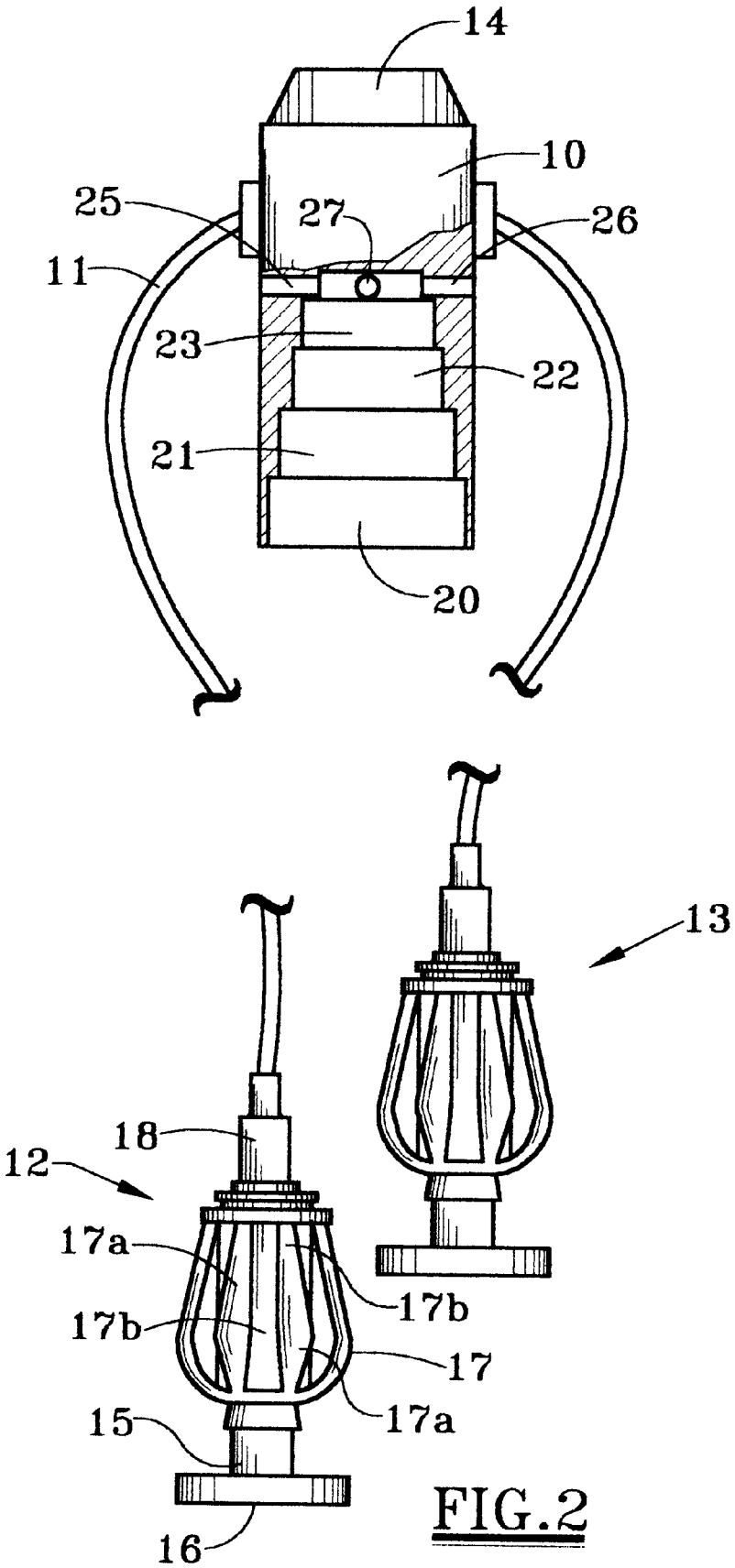
FIG. 2 is a pictorial view of a bola assembly to be utilized with the apparatus of the present invention.

A bola assembly suitable for use with the apparatus of the present invention is illustrated in FIG. 2. The bola assembly comprises a cylindrical plug 10 from each side of which extends a cord 11 at the opposite ends of which are weight members 12 and 13. The cord can be made of material with polymer properties. Super-strong, high-impact fishing line has been found to be very suitable. A plurality of cords may be banded together or the cord 11 can be made from extruded material of a number of composite cross-sectional areas. The cord 11 is preferably of a single length. However, it could be made of three equal lengths connected to the central plug member 10. Whether of one or more lengths, the cord 11 can be attached to the central plug in any number of ways. For example a slot (not shown) may be provided at the upper end of the central plug for placing the cord 11 therein. Then the cord can be secured by a wedge (not shown) in the slot held in place by a preferably rubber cap or nose 14. The lower portion of the central plug 10 is counterbored with multiple counterbores 20, 21, 22, 23, 24 of reducing diameter from the bottom up. The top bore 24 has four radial relief holes 25, 26 27 at ninety degree orientations, the purpose of which will be more fully understood hereafter.

The weight members 12, 13 can be made in a number of ways. As shown, the weight member 12 comprises a central metallic member 15 at the lower end of which is provided a flange 16. A centrally bored weight 17 and a resilient sheath 18 may be provided. The end of the cord 11 is threaded through the sheath 18, weight 17 and the metallic member 15 and tied off to the flange 16. It will be noted that the weight 17 is tapered downwardly and outwardly and slots 17*a* are machined therein leaving downwardly and outwardly tapered ribs 17*b* thereon.

Referring again to FIG. 1, a pair of elongated tubular members 30, 31 are attached to the gun G by mounts 32 and 33. The tubular members 30, 31 are substantially parallel to each other and to the gun barrel 1. The forward or upper end of the tubular members 30, 31 are open. As perhaps more clearly seen in FIG. 4, the last few inches of the tubular members 30 and 31 are slightly curved or bent in outwardly diverging directions. A portion of the wall of each of the tubular members 30, 31 farthest from the gun barrel at the curved ends thereof are removed as at 34 and 35. In addition, an elongated slot 36, 37 may be provided in the wall of each tubular member 30, 31 opposite the removed areas 34, 35.

Figure 3:
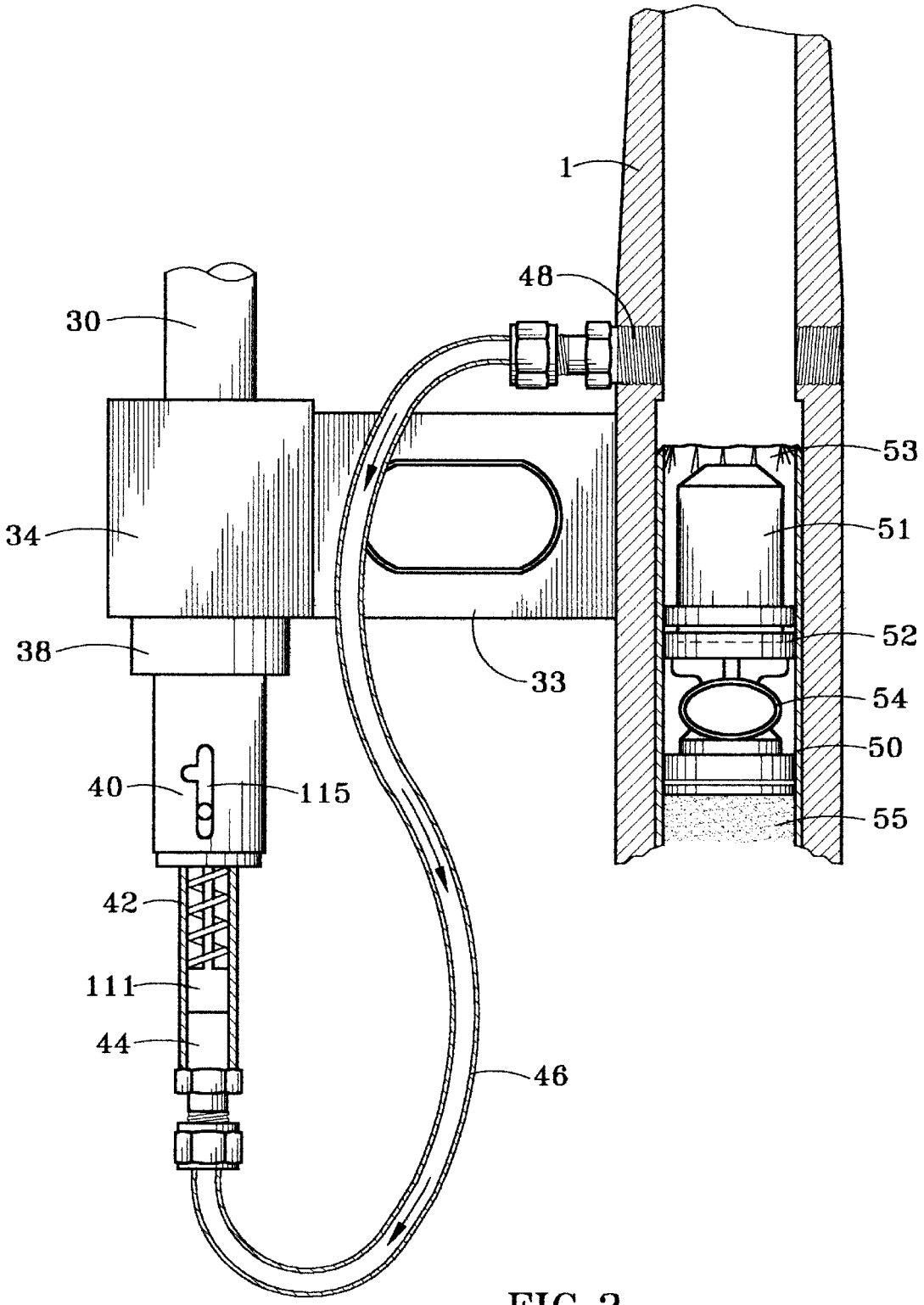
FIG. 3 is a cutaway portion, partially in section, of the capturing apparatus of FIG. 1.

At the rearward end of each tubular member 30, 31 is a retainer assembly 40, 41 the purpose of which is to retain the weights 12, 13 of the bola assembly shown in FIG. 2. The design and operation of the retainer assemblies 40, 41 will be described in more detail hereafter. The lower ends of the tubular members 30, 31 are held in place by clamps 34, 35 attached to the mount 33. The retainer assemblies 40, 41, held in place by clamps 38, 39, include cylinders 42, 43 in which are provided chambers, as best seen with reference to the chamber 44 within the cylinder 42 of FIG. 3. These chambers are in fluid communication through conduits 46, 47 and ports, such as port 48 in FIG. 3, with the gun barrel 1 just forward of the end of a shell illustrated at 50 in FIG. 3, when the shell is properly placed in the gun barrel. Incidently, the shell 50 is a shotgun shell from which the shot has been removed and replaced with a cylindrical rubber slug 51 with a flanged rim 52 about its base. As the shot is removed from the shell 50, the slug 51 is placed in the end of the shell casing and the casing is crimped, as at 53, before loading into the gun. A cushion and gas sealing member 54 may be placed between the slug 51 and the powder 55 in the shell.

Figure 4:
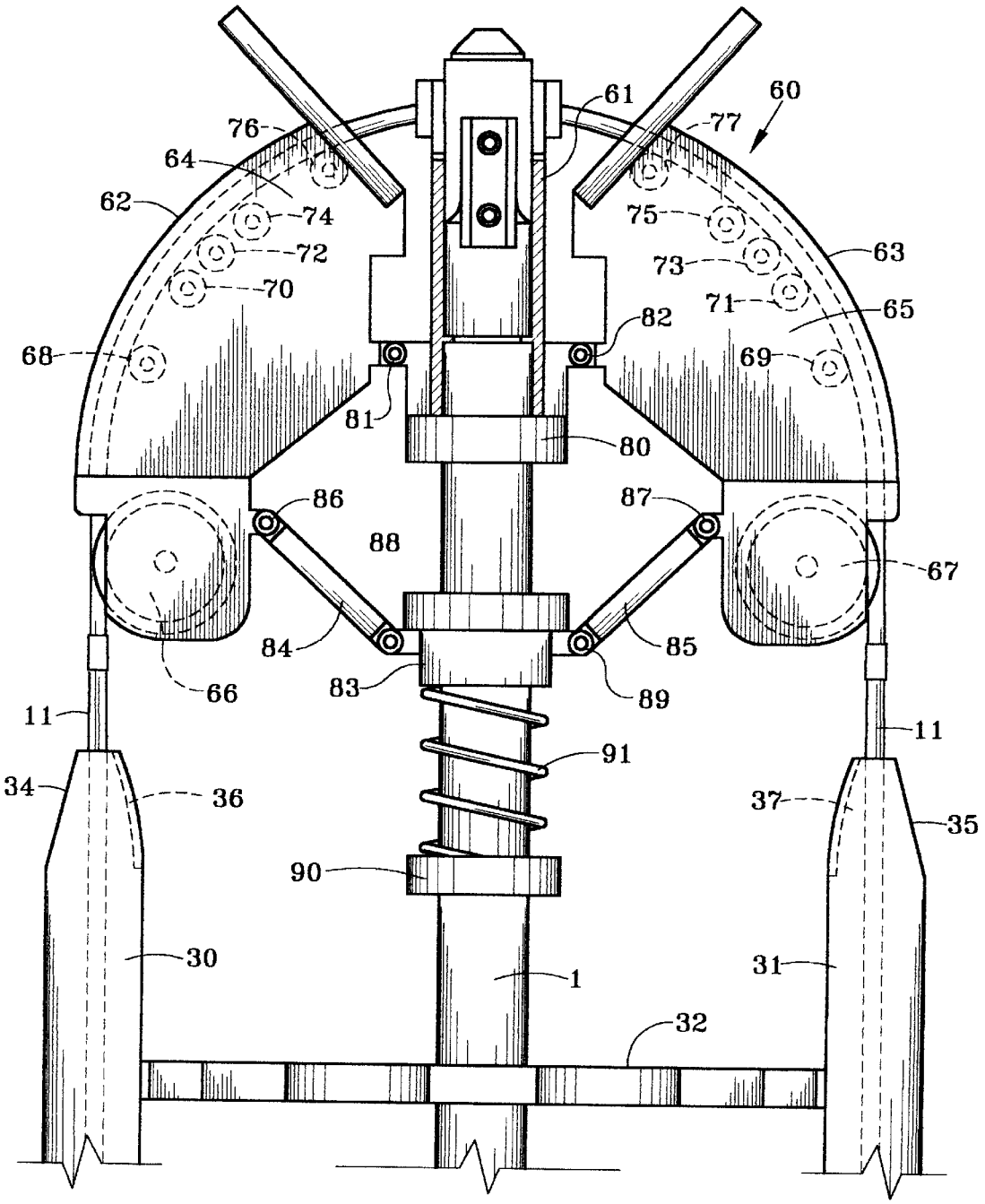
FIG. 4 is an enlarged top view of the forward end of the capturing apparatus of the present invention.

As best seen in FIGS. 1 and 4, a guide assembly 60 is attached to the forward end of the gun barrel 1 and has a central tube 61 coaxially aligned with the gun barrel 1 and on each side of which are outwardly extending guides 62, 63. Each of the outwardly extending guides 62, 63 comprises a pair of plates 64, 65 between which are carried a plurality of groove rimmed wheels 66, 68, 70, 72, 74, 76 on the left side and 67, 69, 71, 73, 75, 77 on the right side. Each of the wheels is rotatable on axes which are perpendicular to the axis of the gun barrel 1. The central tube 61 is attached to the barrel by a clamp 80. Each of the pair of the guides 62, 63 and the guide plates 64, 65 thereof are pivotally attached to the clamp 80 at 81 and 82 for pivoting about axes which are parallel to the axes of the grooved rimmed wheels 66–77 for pivoting between inner positions and outer positions. Surrounding the gun barrel 1 is a collar member 83 which is moveable thereon. Each of the guide plates 64, 65 is attached to the collar member 83 by linkages 84 and 85 and pivot connections 86, 87, 88, 89 at the ends of the linkages 84, 85. Surrounding the gun barrel 1 between movable collar 83 and a fixed stop member 90 is a helically wound spring 91. The spring 91 biases each of the guides 62, 63 of the guide assembly 60 toward outer positions and serves as a shock absorber.

Figure 5:
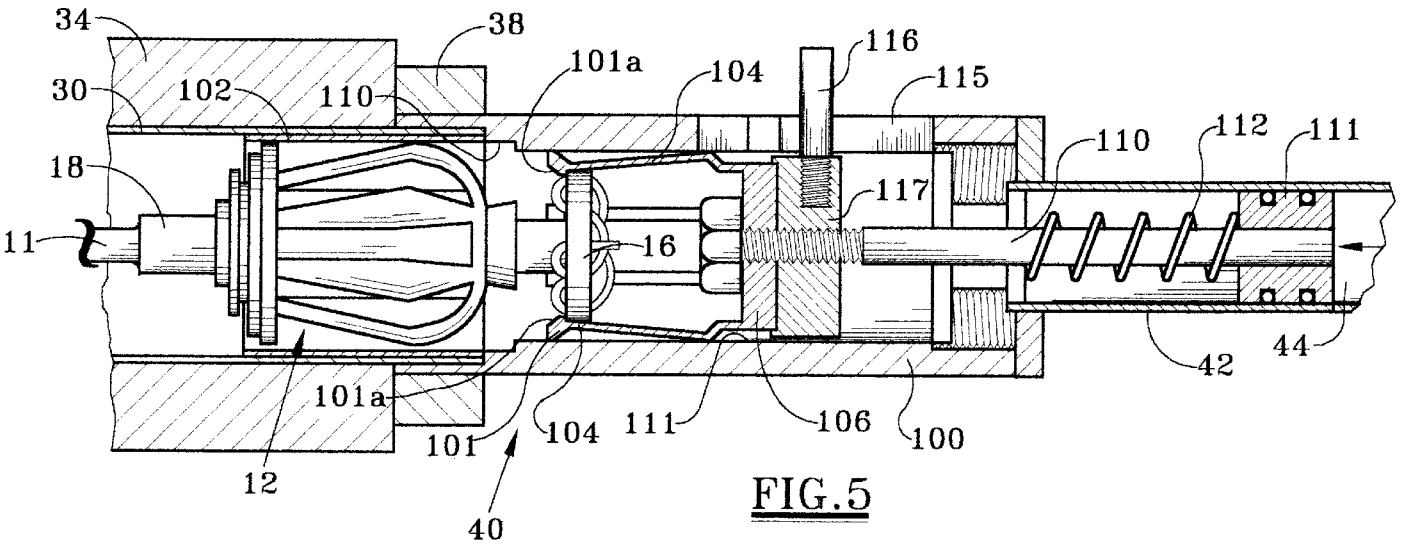
FIG. 5 is a detailed view, in section, showing a retainer assembly portion of the present invention, in a retaining position.
Figure 6:
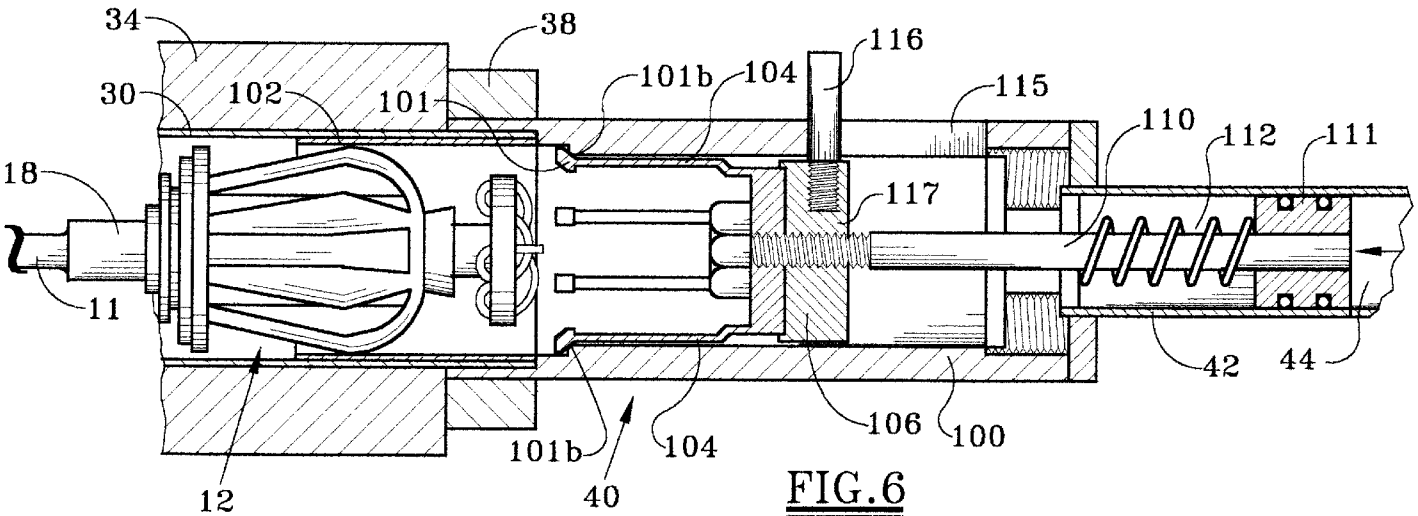
FIG. 6 is a similar detailed sectional view of the retainer assembly of FIG. 5 but showing the retainer in a releasing position and the bola weight in flight.

Reference is now made to FIGS. 5 and 6 for a more complete description of the retainer assemblies 40 and 41. Since retainer assemblies 40 and 41 are essentially identical, only one, i.e. retainer assembly 40, will be described in detail. The retainer assembly 40 comprises a cylindrical housing 100 in which are carried latching elements 101 for releasable engagement with a latch shoulder provided on the flanged end 16 of a respective one of the bola weight members, in this case weight member 12. One end of the cylindrical housing 100 is counterbored to receive the end of tubular member 30 and a cylindrical sleeve 102 at the end of tubular member 30. The clamp 38 (see FIGS. 1 and 3) surrounds the end of cylinder 100 and the tubular member 30 in the area of the sleeve 102 to hold these members in place.

The latching elements 101 are carried on the distal ends of a plurality of spring finger members 104 which project from a ring base 106. There are a number of these spring fingers 104, e.g. six, equally spaced around the interior of the cylinder 100. The ring base 106 is attached to a rod 110 at the opposite end of which is a piston 111 carried in the piston cylinder 42. The gas chamber 44, of variable volume, is defined by the end of the piston 111 and the end of the cylinder 42. A helical spring 112 surrounding the piston rod 110 biases the piston 111, the latch ring base 106 and the spring fingers 104 attached thereto downwardly as viewed in FIG. 1 or to the right as viewed in FIGS. 5 and 6.

It should be noted that the housing 100 is counterbored at 110 providing a section which is of larger diameter than the smaller diameter interior 111. It should also be noted that the latching elements 101 at the ends of the spring fingers 104, are provided with radially inwardly extending teeth 101*a* and that the outer portion thereof are tapered at 101*b*.

The latch ring base 106, spring fingers 104 and the latching elements 101, being operatively connected to the piston 111 by rod 110, are reciprocally moveable within the housing 100 between a far right position as shown in FIG. 5 and a far left position as shown in FIG. 6. When these elements are in the far right position of FIG. 5, the latching elements 101 are surrounded by the smaller diameter interior 111 of the cylinder 100 holding the latching elements 101 inwardly so that the teeth 101*a* engage the shoulder of the flange 16 retaining the bola weight member 12 therein. However, if the latch ring base 106, spring fingers 104 and the latching elements 101 are moved to the far left position, as in FIG. 6, the latching elements 101 spring outwardly for disposition in the larger diameter section 110 in which the latching elements 101 are allowed to disengage the flange 16 of the weight member 12 and releasing the weight member 12 therefrom.

It will be noted that a slot 115 is cut in one wall of the cylinder 100. Extending through the slot 115 is a rod or lever 116 which is threaded to a member 117 which is fixed relative to the latch ring base 106 and the piston rod 110. The lever 116 is manually engageable, externally of the retainer assembly housing 100, for moving the piston 111 and the latching elements 101 to a release position, such as the position of FIG. 6, allowing initial engagement of the weight member flange 16 with the teeth 101*a* of the latching elements 101. A T-slot 118 may be utilized to hold the lever 116 in this position. Once the engagement takes place, the lever 116 may be released, the spring member 112 then biasing the latching elements 101 and the weight member 12 toward the latched position of FIG. 5.

In operation, the central plug 10 of the bola assembly (see FIG. 2) is inserted into the central tube 61 and the cord 11 positioned for engaging the grooves of the grooved wheels 66–77 of the guides 62, 63. The weight members 12 and 13 are inserted through the open ends of the tubes 30, 31, dropping by gravity toward the retainer assemblies 40, 41. The latching elements of retainer assemblies 40, 41 are manually moved by lever 116 to the position of FIG. 6 so that the flanged ends of the weight members 12 and 13 may be engaged by corresponding latching elements 101. Then the latch ring base 106 and fingers 104 are released so that the biasing spring 112 moves the latching elements 101 and the bola weight members 12, 13 into latched positions such as illustrated in FIG. 5. A shell 50 is placed in the gun. The capturing device is thus loaded and ready for firing.

The gun G is then aimed at a fleeing animal or person and fired as with any shotgun. The subsequent explosion produces gases which are directed through the conduits 46, 47 to the chambers 44 in the gas cylinders 42, 43 driving the pistons therein, e.g. piston 111 in FIGS. 5 and 6, and forcing the latch ring base 106, latch fingers 104 and latching elements 101 toward the release position of FIG. 6. Substantially simultaneously therewith, the rubber slug 51 (see FIG. 3) is propelled down the gun barrel 1 and into the counterbores 20–24 of the central plug 10 propelling the bola plug 10 from the central tube 61 and the bola weight members 12, 13 from the elongated tubular members 30, 31. Gas and parts of the disintegrating slug 51 escape through the relief holes 25, 26, 27 of the plug 10 preventing damage thereto. The guides 62, 63 and the slightly curved ends of the tubular members 30, 31 spread the weight members 12, 13 on either side of the bola plug 10 and propel the bola assembly toward the fleeing animal or person causing the bola cords 11 to wrap around the legs of the animal or person in their path, entangling their legs and assisting in the capture thereof.

The apparatus has an effective range of fifty or sixty yards. It is relatively simple to manufacture and operate. Most importantly, it allows the capture of a fleeing animal or person with minor or no injury thereto.

A single embodiment of the invention has been described herein. Many variations can be made by those skilled in the art without departing from the spirit thereof. Accordingly, it is intended that the scope of the invention be limited only the claims which follow.

What is claimed is:

1. Apparatus for capturing fleeing animals or persons comprising:

a gun having a barrel and stock;

a pair of elongated tubular members attached to said gun, one on each side of said gun barrel and substantially parallel thereto;

a guide assembly attached to the end of a said gun barrel including a central tube coaxially aligned with said gun barrel and on each side of which extends guide members;

a pair of retainer assemblies, one at the rear end of each of said tubular members, each having a chamber in fluid communication with the interior of said gun barrel; and a bola assembly comprising a central plug from each side of which extends a cord at the end of which are weights, said plug being insertable into said central tube of said guide assembly, each of said weights being insertable through a respective one of said elongated tubular members for releasable engagement with a corresponding one of said retainer assemblies so that subsequent firing of a shell in said gun directs gases to said retainer chambers activating said retainer assemblies to release said weights as said bola plug is struck by a slug portion of said shell, propelling said bola assembly toward said fleeing animal or person.

2. Capturing apparatus as set forth in claim 1 in which the forward end of each tubular member is slightly curved in outwardly diverging directions to assure clearance of said bola weights past said guides as said weights are propelled from said tubular members.

3. The capturing apparatus set forth in claim 2 in which a portion of the wall of each of said tubular members farthest from said gun barrel, where curved, is removed.

4. The capturing apparatus set forth in claim 3 in which an elongated slot is provided in the wall of each of said tubular members opposite the portion of said wall which has been removed.

5. The capturing apparatus set forth in claim 1 in which each of said extending guides comprises a pair of plates between which are carried a plurality of groove rimmed wheels rotatable on axes which are perpendicular to he axis of said gun barrel, said bola cord engaging the grooves of said groove rimmed wheels when said bola plug and said bola weights are properly inserted in and engaged with said central tube and said retainer assemblies, respectively.

6. The capturing apparatus set forth in claim 5 in which said central tube is attached to said barrel by a fixed mounting, each of said pair of guide plates being pivotally attached to said fixed mounting for pivoting about an axis parallel to the axes of said groove rimmed wheels between inner positions and outer positions, biasing means biasing said guides toward said outer positions.

7. The capturing apparatus set forth in claim 6 in which said biasing means comprises a collar member surrounding said gun barrel near said fixed guide mounting and moveable thereon, each of said pair of guide plates being pivotally attached to said collar member, a spring member engaging said collar member biasing said collar member toward said fixed guide mounting and said guides toward said outer positions.

8. The capturing apparatus as set forth in claim 7 including a fixed stop member surrounding said gun barrel below said collar member, said spring member being a helically wound spring surrounding said gun barrel between said collar member and said stop member biasing said collar in an upward direction and said guides toward said outer positions.

9. Capturing apparatus as set forth in claim 1 in which each of said retainer assemblies comprises a cylindrical housing in which are carried latching elements for releasable engagement with a latch shoulder provided on the end of a respective one of said bola weights, said latching elements being operatively connected to a piston member carried in said chamber and moveable therewith from a latching position, in which said latching elements engage said latch shoulder retaining said bola weights, to a release position in which said latching elements release said bola weights, in response to said direction of gases to said chamber.

10. Capturing apparatus as set forth in claim 9 in which said bola weights comprise, at the ends thereof, a flange member on which said latch shoulder is provided, said latching elements of said retainer assembly extending radially inwardly for releasable engagement with said flange member and said latch shoulder thereon.

11. Capturing apparatus as set forth in claim 10 in which said cylindrical housing has adjacent sections, one of a smaller diameter than the other, said latching elements, when in said latching position, being surrounded by said smaller diameter section to retain said bola weights therein, said latching elements being moveable by said piston member to said other section which allows outer movement of said latching elements and release of said bola weights.

12. Capturing apparatus as set forth in claim 11 in which said piston is operatively connected to a release device manually engageable externally of said retainer assembly housing for moving said piston and said latching elements to said release position allowing initial engagement of said weight member with said retainer assembly.

13. Apparatus for capturing fleeing animals or persons comprising:

a gun having an elongated barrel attached to a stock;

a pair of elongated tubular members attached to said gun, one on each side of said barrel and substantially parallel thereto, each tubular member having a forward end and a rearward end, the forward end of each tubular member being open;

a guide assembly attached to said forward end of said gun barrel having a central tube coaxially aligned with said gun barrel and on each side of which are outwardly extending guides;

a retainer assembly at said rearward end of each of said elongated tubular members and including a chamber in fluid communication, through a conduit and a port in said gun barrel, with the interior of said gun barrel just forward of the end of a shell when said shell is properly placed in said gun barrel; and a bola assembly comprising a central plug from each side of which extends a cord at the end of which is a weight member, said plug being insertable into said central tube of said guide assembly and each of said weight members being releasably engageable with a respective one of said retainer assemblies at said rearward ends of a corresponding one of said elongated tubular members, said cord then engaging a corresponding one of said guides, the firing of a shell in said gun barrel creating gases which are directed to said chambers to activate said retainer assemblies, releasing said weight members as said central plug is struck by a part of said shell and propelling said bola plug from said central tube and said bola weights from said elongated tubular members causing said bola cord to wrap around any fleeing animal or person in said bola assembly's path.

14. The capturing apparatus set forth in claim 13 in which the forward end of each tubular member is slightly curved in outwardly diverging directions to assure clearance of said bola weight members past said guides as said weight members are propelled from said tubular members.

15. The capturing apparatus set forth in claim 14 in which each of said extending guides comprises a plurality of groove rimmed wheels rotatable on axes which are perpendicular to the axis of said gun barrel, said bola cord engaging the grooves of said groove rimmed wheels when said bola plug and said bola weights are properly inserted in and engaged with said central tube and said retainer assemblies, respectively.

16. The capturing apparatus set forth in claim 15 in which said central tube is attached to said barrel by a fixed mounting, each of said outwardly extending guides being pivotally attached to said fixed mounting for pivoting about an axis parallel to the axes of said groove rimmed wheels between inner positions and outer positions, biasing means biasing said guides toward said outer positions.

17. The capturing apparatus set forth in claim 16 in which said biasing means comprises a collar member surrounding said gun barrel and moveable thereon, each of said extending guides being pivotally attached to said collar member, a spring member engaging said collar member biasing said collar member toward said fixed guide mounting and said guides toward said outer positions.

18. Capturing apparatus as set forth in claim 13 in which each of said retainer assemblies comprises a cylindrical housing in which are carried latching elements for releasable engagement with the end of a respective one of said bola weight members, said latching elements being operatively connected to a piston member carried in said chamber and moveable therewith from a latching position, in which said latching elements engage and retain said bola weight members, to a release position in which said latching elements release said bola weight members, in response to said direction of gases to said chamber.

19. Capturing apparatus as set forth in claim 18 in which said bola weight members comprise, at the ends thereof, a flange member, said latching elements of said retainer assembly extending radially inwardly for releasable engagement with said flange member.

20. Capturing apparatus as set forth in claim 19 in which said cylindrical housing has adjacent sections, one of a smaller diameter than the other, said latching elements, when in said latching position, being surrounded by said smaller diameter section to retain said bola weight member therein, said latching elements being moveable by said piston member to said other section which allows outer movement of said latching elements and release of said bola weight member.

* * * * *